US005185052A

United States Patent [19]

Chappell et al.

[11] Patent Number: 5,185,052

[45] Date of Patent: Feb. 9, 1993

[54] HIGH SPEED PLEATING APPARATUS

[75] Inventors: Charles W. Chappell, West Chester; John J. Angstadt, Cincinnati, both of Ohio

[73] Assignee: The Procter & Gamble Company, Cincinnati, Ohio

[21] Appl. No.: 534,055

[22] Filed: Jun. 6, 1990

[51] Int. Cl.[5] ..... B31F 1/22

[52] U.S. Cl. ..... 156/462; 156/474; 425/336; 493/339; 493/463; 493/471

[58] Field of Search ..... 156/462, 474; 493/463, 493/339, 442, 471; 29/116.1, 121.8; 425/336

[56] References Cited

U.S. PATENT DOCUMENTS

| | | | |
|---|---|---|---|
| 654,884 | 7/1900 | Ferres | 156/462 |
| 1,807,009 | 5/1931 | Pinnelli | 29/116.1 X |
| 1,820,338 | 8/1931 | Youngchild et al. | 29/116.1 X |
| 2,030,746 | 2/1936 | Galligan et al. | 428/152 |
| 2,075,189 | 3/1937 | Galligan et al. | 428/152 |
| 2,393,191 | 1/1946 | Robertson | 29/116.1 X |
| 2,547,880 | 4/1951 | Meyer et al. | 156/201 |
| 2,793,676 | 5/1957 | Hubmeier | 156/462 X |
| 3,332,131 | 7/1967 | Weiler | 29/116.1 X |
| 3,542,625 | 11/1970 | Vernier | 156/435 |
| 3,784,186 | 1/1974 | Lenthall et al. | 270/64 |
| 3,804,695 | 4/1974 | Randall et al. | 156/462 X |
| 3,878,620 | 4/1975 | Gallahue et al. | 34/41 |
| 3,993,532 | 11/1976 | McDonald et al. | 29/116.1 X |
| 4,116,892 | 9/1978 | Schwarz | 521/62 |
| 4,144,008 | 3/1979 | Schwarz | 425/66 |
| 4,153,751 | 5/1979 | Schwarz | 428/304 |
| 4,223,059 | 9/1980 | Schwarz | 428/198 |
| 4,252,591 | 2/1984 | Rosenberg | 156/203 |
| 4,377,431 | 3/1983 | Chodosh | 156/204 |
| 4,397,704 | 8/1983 | Frick | 156/201 |
| 4,517,714 | 5/1985 | Sneed et al. . | |
| 4,596,523 | 6/1986 | Whitehead | 425/367 |
| 4,806,300 | 2/1989 | Walton et al. | 264/288.8 |
| 4,832,186 | 5/1989 | Conrad | 198/840 |
| 4,862,565 | 9/1989 | Damour | 26/99 |
| 4,930,202 | 6/1990 | Yano . | |

FOREIGN PATENT DOCUMENTS

| | | | |
|---|---|---|---|
| 220899 | 11/1957 | Australia | 493/463 |
| 758794 | 5/1967 | Canada | 93/13 |
| 0364392A2 | 4/1990 | European Pat. Off. . | |
| 0373942A2 | 6/1990 | European Pat. Off. . | |
| 0409315A1 | 1/1991 | European Pat. Off. . | |
| 0431275A3 | 6/1991 | European Pat. Off. . | |
| J0 2182-987-A | 6/1989 | Japan . | |
| WO91/19033 | 12/1991 | PCT Int'l Appl. . | |
| 1070542 | 6/1967 | United Kingdom . | |

OTHER PUBLICATIONS

Summary Report on the Use of Curved Axis Rolls for Wrinkle Prevention on Paper and Plastic—Bruce A. Feiertag—Fife Corporation—Apr. 22, 1981.

*Primary Examiner*—Michael W. Ball
*Assistant Examiner*—Michele K. Yoder
*Attorney, Agent, or Firm*—Stephen P. Kearney; Larry L. Huston; Steven W. Miller

[57] ABSTRACT

Disclosed is an apparatus for longitudinally pleating a moving lamina. The apparatus features a curved axis roll having a stationary axis circumscribed by a rotating sleeve with a plurality of circumferentially oriented grooves in the rotating sleeve. The pleats are produced by the intermeshing of the lamina with the grooves of the rotating sleeve. Preferably a complementary curved axis roll having lands which interdigitate with the grooves of the first roll is used in conjunction with the first curved axis roll.

The apparatus preferably further comprises a third curved axis roll disposed upstream of the first curved axis roll to substantially equalize the paths of travel of any points on the moving lamina by compensating for differences in the paths of travel between the edges and centerline of the lamina. The apparatus may further comprise two straight axis rolls disposed outboard of the curved axis rolls and spatially arranged so that the paths of travel of either edge of the lamina and the centerline of the lamina through the apparatus and from the first straight axis roll to the second straight axis roll are substantially equal.

7 Claims, 4 Drawing Sheets

HIGH SPEED PLEATING APPARATUS

TECHNICAL FIELD

The present invention relates to an apparatus for pleating a moving lamina in its direction of travel, and more particularly to an apparatus which utilizes one or more rolls to induce the pleats in the lamina without tensioning the lamina perpendicular to its path of travel.

BACKGROUND OF THE INVENTION

Apparatuses for longitudinally pleating a lamina are known and have long been utilized in the art. For example, Canadian Patent 758,794 issued May 16, 1967, to Ives et al. discloses one such apparatus having convergent longitudinal sections to induce the pleats. The use of interdigitating circumferentially grooved rolls is known in the prior art, as illustrated by U.S. Pat. No. 4,517,714 issued May 21, 1985, to Sneed et al., which patent discloses a process for lateral tensioning of a lamina through the use of ring rolling. The prior art further teaches the use of a curved axis roll to laterally spread a lamina, as disclosed in U.S. Pat. No. 2,393,191 issued Jan. 15, 1946 to Robertson.

The prior art does not, however, teach an apparatus for longitudinally pleating a moving lamina by the use of rolls and without laterally tensioning the lamina. The prior art further does not teach an apparatus using multiple rolls or curved axis rolls to achieve substantial equalization of the paths of travel, taken in the machine direction, of any transversely corresponding points on the lamina.

It is an object of this invention to provide an apparatus for longitudinally pleating a moving lamina. It is further an object of this invention to provide an apparatus which achieves substantially equal machine direction travel of all points on the lamina as it passes through the apparatus. Finally, it is an object of this invention to provide an apparatus which can be used at relatively high speeds, e.g. at least about 180 meters per minute (600 feet per minute).

SUMMARY OF THE INVENTION

The invention comprises an apparatus for longitudinally pleating a moving lamina. The apparatus features a curved axis pleating roll having a stationary axis of curvature, a stationary core and an axially rotatable sleeve. The rotatable sleeve has a plurality of circumferentially oriented grooves through which the moving lamina passes.

The apparatus may further comprise another curved axis roll, the compensating roll. The curved axis compensating roll has a stationary axis of curvature, and a stationary core and a generally smooth, axially rotatable sleeve. The compensating roll is configured and spatially arranged within the apparatus to provide substantially equal machine direction travel of all transversely corresponding points on the lamina, particularly the center and outboard edges of the lamina, as it travels through the apparatus.

In one execution, the apparatus comprises, in series, a first straight axis roll with a smooth axially rotatable sleeve, a first curved axis compensating roll having a stationary axis and a generally smooth axially rotatable sleeve, a second curved axis pleating roll having a stationary axis and an axially rotatable sleeve with a plurality of transversely spaced circumferential grooves, and a second straight axis roll with a circumferentially grooved axially rotatable sleeve. The four rolls are arranged so that the aggregates of paths of travel of any two transversely corresponding points on the lamina, taken in the machine direction from the first straight axis roll through the second straight axis roll, are substantially equal.

In either of the aforementioned executions, having one to four rolls, the apparatus may further comprise a curved axis interdigitating roll, which is used in conjunction with the pleating roll. The interdigitating roll has a circumferentially grooved axially rotatable sleeve. The stationary curved axis and axially rotatable sleeve of the interdigitating roll are complementary to the stationary curved axis and the axially rotatable sleeve of the pleating roll. The pleating roll and the interdigitating roll are juxtaposed to provide a corrugated nip through which the moving lamina may pass.

BRIEF DESCRIPTION OF THE DRAWINGS

While the Specification concludes with claims particularly pointing out and distinctly claiming the invention, it is believed the same will be better understood from the following figures taken in conjunction with the accompanying descriptions in which like parts are given the same reference numeral, tangent points centered on the apparatus are designated with a reference letter, analogous tangent points at the edge of a lamina are designated with a prime symbol, analogous tangent points at the end of a roll are designated with a double prime symbol, spans between points on the centerline of the apparatus and lamina are designated with parenthesis and no prime symbols, spans between points on the edge of a lamina are designated with parenthesis and one prime symbol, the machine direction distance between the ends of rolls are designated with a capitalized Span, underlined parenthesis and double prime symbols (to indicate this is not a measurement of points on the lamina), and:

DETAILED DESCRIPTION OF THE INVENTION

Figure 1:
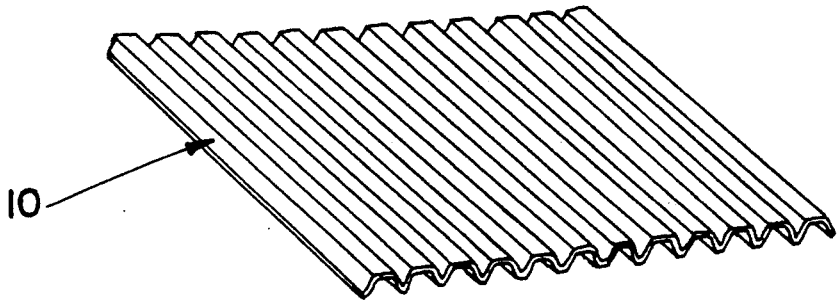
FIG. 1 is a perspective view of a lamina produced according to the apparatus of the present invention.

The present invention is directed to an apparatus 15 for pleating a lamina 10 and the lamina 10 produced by such apparatus 15. The pleated lamina 10, illustrated in FIG. 1, may be combined with an unpleated lamina 11 to form a unitary laminate, or otherwise utilized as desired for the end use. As used herein, a "lamina" refers to any generally planar material capable of deformation normal to the plane.

Suitable materials for the lamina 10 include nonwoven fabrics and formed films. Polypropylene nonwoven fabrics having a thickness of about 0.08 millimeters to about 1.3 millimeters (0.003 to 0.050 inches) and low density polyethylene formed films about 0.03 millimeters to about 0.08 millimeters (0.001 to 0.003 inches) in thickness have been found to be suitable laminae 10 for the claimed apparatus 15. It will be apparent that as the lamina 10 becomes thicker, the pitch between adjacent pleats should also be increased.

The pleats of the pleated lamina 10 are generally parallel, may be of any reasonable desired depth and width, may be spaced apart as desired, and are substantially oriented in the machine direction. As used herein, the phrase "machine direction" refers to the principal direction of travel of the lamina 10 as it passes or traverses a roll or the nip between two rolls, and is generally orthogonal the axes of such roll or rolls.

Figure 2:
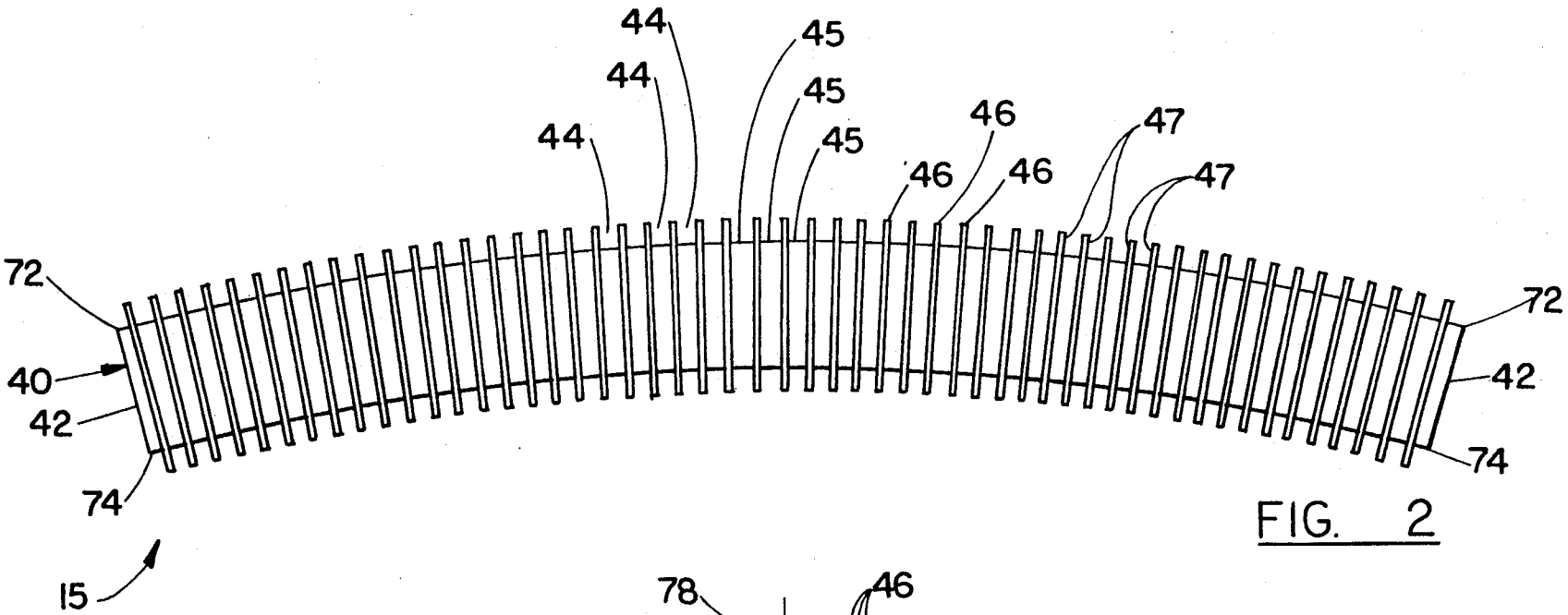
FIG. 2 is a top plan view of a curved pleating roll having circumferential grooves.
Figure 5:
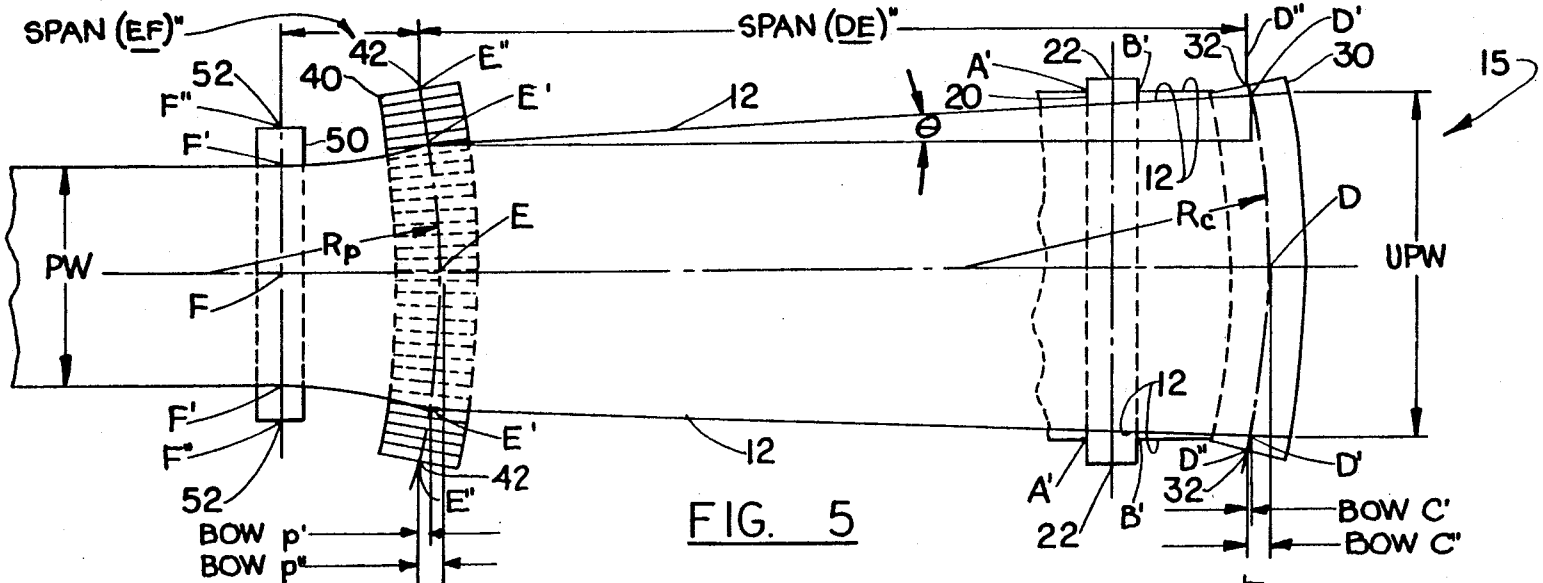
FIG. 5 is a schematic top plan view of one apparatus according to the present invention, having the interdigitating roll omitted for clarity.
Figure 6:
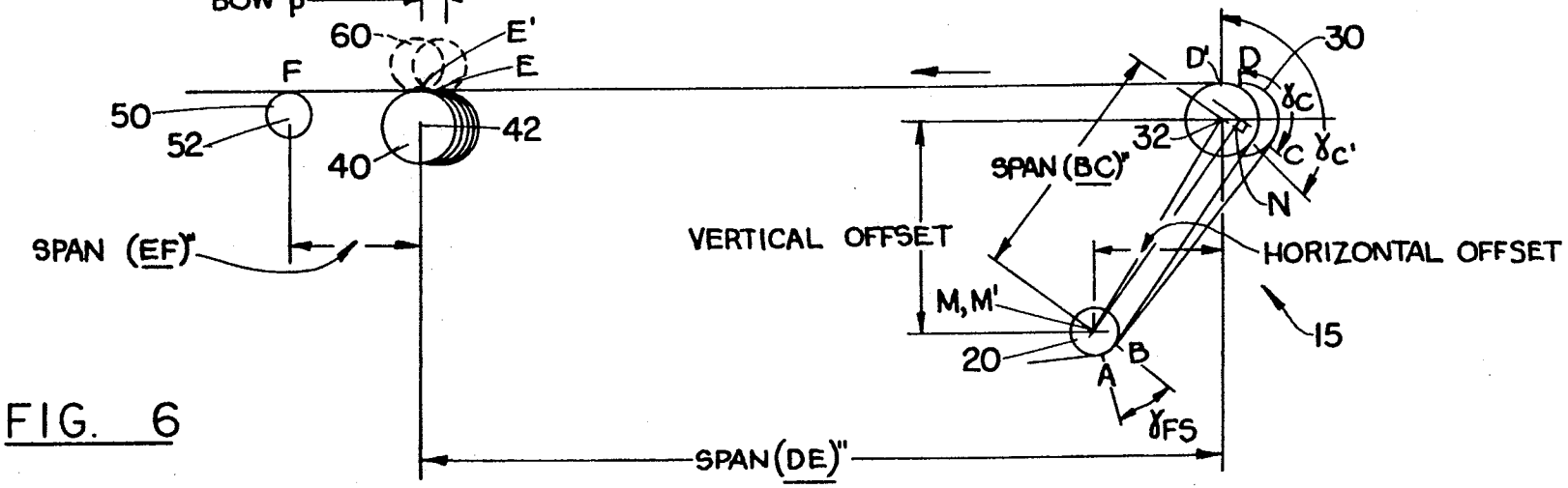
FIG. 6 is a schematic side elevational view of the apparatus of FIG. 5.

As illustrated in FIG. 2, a principal component of the apparatus 15 is a curved pleating roll 40 having a stationary axis, a stationary core and an axially rotatable outer sleeve with circumferentially oriented grooves 44. The apparatus 15 preferably comprises another curved axis roll 30 having a smooth surface and referred to as the "compensating roll." The compensating roll 30, as illustrated in FIGS. 5 and 6, is disposed before the circumferentially grooved pleating roll 40 so that the lamina 10 traverses the circumference of the compensating roll 30 prior to reaching the pleating roll 40.

The apparatus 15 preferably further comprises two straight axis rolls 20 and 50. The two straight axis rolls 20 and 50 are disposed outboard of the two curved axis rolls 30 and 40 as referenced in the machine direction, so that one straight axis roll 20 is before the compensating roll 30 and one straight axis roll 50 is after the pleating roll 40. The second straight axis roll 50 is preferably circumferentially grooved, to maintain the newly-formed pleat geometry.

The apparatus 15 may further comprise a second circumferentially grooved curved axis roll 60 juxtaposed in interdigitating relationship with the circumferentially grooved curved pleating roll 40 and referred to as an "interdigitating roll." This arrangement defines a corrugated nip between the two circumferentially grooved curved axis rolls 40 and 60.

The rolls are mounted on any suitable frame (not shown) and, for example, may be cantilevered or supported at each end. The lamina 10 is supplied from any suitable means for supplying a lamina 10 (not shown), such as a supply roll.

The lamina 10 may be drawn through the apparatus 15 at a relatively high rate of speed. Lamina 10 velocities in the machine direction of about 15 to about 305 meters per minute (50 to 1,000 feet per minute) in the machine direction are feasible, with good results being obtained at velocities of about 180 meters per minute (600 feet per minute).

THE APPARATUS HARDWARE

Referring to FIG. 2 and examining each of the components in more detail, an axially rotatable means for pleating the lamina 10, referred to as the "pleating roll," comprises an imaginary curved axis, generally centered within the roll 40 and circumscribed by a circumferentially grooved axially rotatable sleeve. This pleating roll 40 may also have a stationary core, typically made of steel, inside the rotatable sleeve. The stationary core and rotatable sleeve may be radially connected through a plurality of journal bearings intermediate the sleeve and core. The journal bearings are preferably axially rotatable and pressed onto the stationary core. The axis, core, bushings and sleeve of the pleating roll 40 are substantially mutually concentric and substantially mutually coaxial.

The imaginary curved axis and core (if included) of the pleating roll 40, and of the other curved axis rolls 30 and 60 comprising the apparatus 15, do not rotate, but remain stationary —so that the ends 42 and centerline of the pleating roll 40 are held in fixed relationship relative to the frame and other components of the apparatus 15. This stationary curved axis defines a plane, which plane also remains in fixed relationship relative to the other components of the apparatus 15. The plane defined by the curved stationary axis may be substantially coincident with the horizontal plane for convenience in adapting this portion of the apparatus 15 to other machinery.

The axially rotatable sleeve of the pleating roll 40, or of any curved axis roll 30 or 60, circumscribes both the stationary core and the stationary axis of such roll 30, 40 or 60. The rotatable sleeve should be flexible and constructed from a fatigue resistant material able to accommodate the cyclic bending incurred as the sleeve rotates about the curved axis. A rotatable sleeve made of urethane or neoprene material has been found to work well. The rotatable sleeve has a plurality of transversely spaced circumferentially oriented grooves 44 therein. As used herein, the phrase "circumferentially oriented groove" refers to a channel in a roll, such as the pleating roll 40 or interdigitating roll 60, which channel extends substantially around the circumference of the roll 40 and is generally orthogonal the axis of the roll 40.

The "bottom" of the groove 44 of the rotatable sleeve is that face of the groove 44 which is of the least diameter. The bottom 45 of the groove 44 may be constant radius and oriented generally orthogonal the radii of the stationary axis of the respective rolls. Between the grooves 44 are raised lands 46. As used herein, the term "land" refers to any portion of a roll, and particularly any portion of a circumferentially grooved sleeve, intermediate two grooves 44 and which has a radius greater than that of the bottom 45 of either adjacent groove 44. Each land 46 may be thought of as an annular cantilevered beam having a fixed end proximal to and disposed at the bottom 45 of the groove 44 and a free end disposed at the outer circumference of the roll and distal to the bottom 45 of the groove 44. It is not necessary that the land 46 be of constant radius throughout its entire circumference. It is only necessary that the space between the grooves 44 be interrupted in radius and that the grooves 44 are not contiguous.

The "sides" of the grooves 44 are those radially oriented faces 47 of the groove 44 which extend from the bottom 45 of the groove 44 to the outer circumference of the land 46. The "depth" of the groove 44 is the radial difference between the least radius at the bottom 45 of the groove 44 and the greatest radius of the outermost portion of an adjacent land 46. The "width" of a groove 44 is the axial difference between the sides 47 of the adjacent lands 46 facing and defining such groove 44. The groove 44 may be of any suitable cross section, although a substantially rectangular cross section, as shown, is generally preferred.

Generally as the radial length of the land 46 increases, the land 46 should be made thicker in the axial dimension, to minimize any flexing, particularly in the axial direction, which may occur. A roll having lands 46 about 6 millimeters (0.2 inches) in radial length and about 0.8 millimeters (0.031 inches) in axial thickness is adequate to preclude significant flexing.

The grooves 44 should be axially spaced a distance which is adequate to allow the lamina 10 to proceed through the grooves 44 without excessive bunching or wrinkling, but not be so wide that significant festooning of the portion of the lamina 10 within the grooves 44 may occur. Preferably, the grooves 44 are axially spaced on a pitch of about 4.0 millimeters to about 38 millimeters (0.16 to 1.5 inches). As used herein, the term "pitch" refers to the distance, taken along the axis of the pleating or interdigitating rolls 40 or 60, between the midpoints of adjacent grooves 44. More generally, it will be apparent that if the grooves 44 are of equal width, the pitch is also the axial distance between any two corresponding points of adjacent grooves 44. A pleating roll 40 having a groove 44 depth of about 4.0 millimeters to about 38 millimeters (0.16 to 1.5 inches) is suitable for use with the embodiment described herein.

Figure 3:
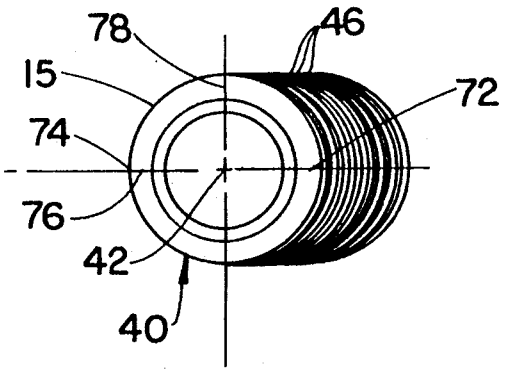
FIG. 3 is a side elevational view of the roll of FIG. 2.

As illustrated in FIG. 3, the curved axis rolls, including the compensating, pleating and interdigitating rolls 30, 40 and 60, may be thought of as having a convex face and an adjacent but symmetrically opposite concave face, each convex and concave face subtending about 180° of the circumference of the rolls 30, 40 and 60. Any cross section of these rolls may be thought of as having two radially oppositely disposed apexes, a convex apex 72 and a concave apex 74, each convex and concave apex 72 and 74 being centered on the circumference of its respective face. The diameter of any cross section terminating at and connecting the convex and concave apexes 72 and 74 lies within the plane defined by the curved axis of the roll and is hereinafter referred to as the "apex connecting line."

Any cross section of these rolls 30, 40 and 60 may be divided into four quadrants by the apex connecting line 76 and the diameter within the plane of the cross section and orthogonal the apex connecting line 76, which orthogonal line is hereinafter referred to as the "apex perpendicular line." The apex perpendicular line 78 defines the coterminous boundary of the concave and convex faces of the roll and also terminates at the circumference of the roll. The apex connecting line 76 and the apex perpendicular line 78 intersect at the center of the roll. Two adjacent quadrants are disposed on the convex side of the roll cross section and subtend the convex face of the roll, and the other two adjacent quadrants are disposed on the concave side of the roll cross section and subtend the concave face of the roll.

The lamina 10 to be pleated traverses and is drawn across a portion of the circumference of the pleating roll 40 subtended by the concave face. The lamina 10 is considered to "traverse" any component of the apparatus 15, such as a roll 20, 30, 40, 50 or 60, if the lamina 10 passes such component in a direction of travel having a vector component oriented in the machine direction and is in contacting relationship with this component. By using the concave face of the pleating roll 40, the lamina 10 may be collapsed, i.e. narrowed in the cross machine direction, without stretching. As used herein, the phrase "cross machine direction" refers to the direction generally orthogonal the machine direction, parallel to the axes of the rolls, and lies within the plane of the lamina 10. Any points of the lamina 10 which lie on the same cross machine direction line are said to "transversely correspond" in position.

The lamina 10 may be wrapped around the concave face of the pleating roll 40 up to an arc of about 180°. If the arc through which the lamina 10 wraps the pleating roll 40 is greater than about 180°, or the convex face is subtended by the lamina 10, cross machine direction tensioning of the lamina 10 may occur. It is preferred that the minimum possible arc of wrap be used, to minimize wrinkling of the lamina 10 within the grooves 44. More preferably the lamina 10 should traverse the pleating roll 40 only at a point of tangency—so that bunching and wrinkling of the lamina 10 within the grooves 44 is substantially obviated. A particularly preferred point of tangency is at either end of the apex perpendicular line 78.

Figure 4:
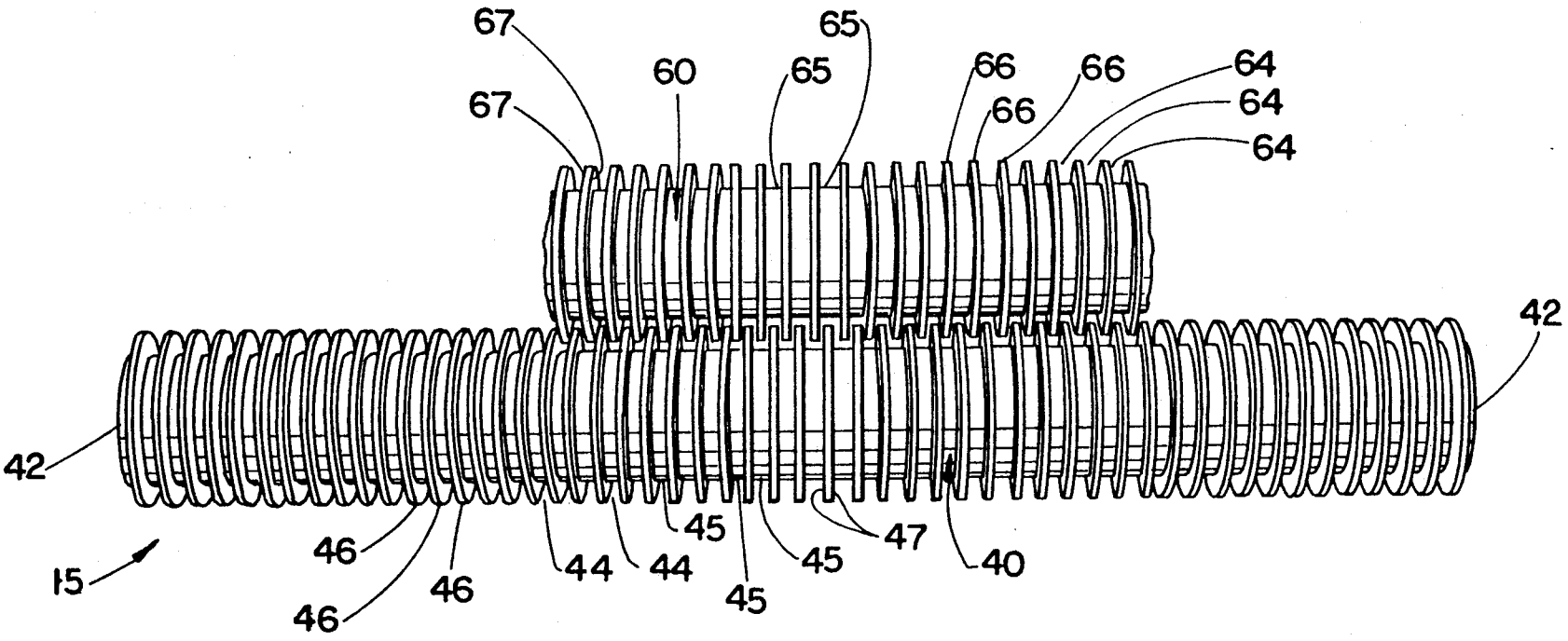
FIG. 4 is a front elevational view of the pleating roll of FIGS. 1 and 2 and a fragmentary complementary interdigitating roll, as viewed in the machine direction.

As illustrated in FIG. 4, to assist in pleating of the lamina 10, a second curved axis roll 60, referred to as the "interdigitating roll", may be provided. The interdigitating roll 60 has a circumferentially grooved axially rotatable sleeve. The axes of the interdigitating roll 60 and the pleating roll 40 are preferably generally equal in radius of curvature. The curved axis of the interdigitating roll 60 is also stationary, and defines a plane which is preferably generally parallel the plane of the axis of the pleating roll 40. The axes, and the planes defined by the axes, are furthermore generally parallel throughout the entire axial length of the sleeves of the pleating and interdigitating rolls 40 and 60.

The rotatable sleeve of the interdigitating roll 60 is complementary to the sleeve of the pleating roll 40. The compensating and pleating rolls 40 and 60, or any two rolls, are considered "complementary" if the radii of curvature of the rolls and the widths and pitches of the lands 46 and 66 and grooves 44 and 64 of the sleeves of the rolls 40 and 60 are matched and registered, allowing the lands 46 and 66 of one roll 40 or 60 to enter the grooves 44 and 64 of the other roll 60 or 40.

The pleating roll 40 and interdigitating roll 60 are complementary and juxtaposed in interdigitating relationship to define a corrugated nip therebetween. As used herein, a "corrugated nip" is the space intermediate and defined by two rolls, which space has an alternating proximity to the axis of each roll 40 and 60. The nip lies on the plane joining the axes of the two rolls 40 and 60 and is generally centered between such axes.

The corrugated nip should have a radial spacing between the bottoms of the grooves 45 of one sleeve and the free ends of the respective interdigitating lands 66 of the other sleeve that allows the lamina 10 to proceed through the corrugated nip without tearing or wrinkling. Similarly, the corrugated nip should have an axial spacing between the sides of adjacent interdigitating lands 46 and 66 and grooves 44 and 64, which spacing is also sufficient to preclude tearing or wrinkling of the lamina 10. A radial spacing between the free end of the land 46 or 66 of one sleeve and the bottom 65 or 45 of the complementary groove 64 or 44 of the other sleeve of about two times the thickness of the material to be pleated, and an axial spacing between the sides 47 and 67 of adjacent interdigitating lands 46 and 66 of about two times the thickness of the material to be pleated is generally sufficient to prevent excessive friction and to minimize wadding or cross machine direction wrinkling of the lamina 10 as it passes through the corrugated nip.

Referring to FIG. 5, the apparatus 15 preferably further comprises means for causing a difference between the length of the path of travel of the centerline of the lamina 10 and the path of travel of an edge 12 of the lamina 10, as the lamina 10 proceeds through the apparatus 15. A preferred means for causing such difference is a curved axis compensating roll 30 disposed before the pleating roll 40. As used herein a "compensating roll" is any rotatable component of the apparatus 15, which component alters the path of travel of the centerline of the lamina 10 relative to an edge 12 of the lamina 10 or vice-versa. Typically, but not necessarily, the compensating roll 30 is immediately before and in series with the pleating roll 40.

As used herein, the terms before and after refer to the relative machine direction positions between two or more components (such as rolls) of the apparatus 15. The component first encountered by the lamina 10 as it travels through the apparatus 15 is "before" the succeeding components. Conversely, the component later encountered by the lamina 10 as it travels through the apparatus 15 is "after" the preceding components. Alternatively, a component which is before another component may be thought of as being upstream of such component. Conversely, the succeeding and later encountered component may be thought of as being downstream of the preceding component. Components of the apparatus 15 are said to be in "series" when the lamina 10 travels from the first, or upstream, component to the succeeding, or downstream, component without encountering another intermediate component which substantially affects the path of travel of the lamina 10 through the apparatus 15.

The compensating roll 30 also has a stationary axis, a stationary core and an axially rotatable sleeve circumscribing the axis and core. The rotatable sleeve of the compensating roll 30 preferentially does not have circumferentially oriented grooves 44 and is relatively smooth, although minor asperities on the surface may be tolerated. The axes of the compensating roll 30 and pleating roll 40 are preferably generally parallel although not necessarily or typically of equal radius of curvature.

Unless otherwise specified, the parallelism of a curved axis roll (relative to either another curved axis roll or to a straight axis roll) is determined by the straight line within the plane of the axis and tangent the apex of the axis, which apex is at the axial centerline of the sleeve of such roll for the embodiments described herein. More specifically, two or more curved axes are considered parallel when the straight lines tangent the apexes of such axes and within the planes defined by the axes are parallel.

The orientation plane of the axis of the compensating roll 30 relative to frame and other components of the apparatus 15 is an adjustable parameter. This plane, in concert with the other adjustable parameters, is oriented at an angle to cause substantial equalization of the machine direction path of any transversely corresponding points on the lamina 10 as it travels from the compensating roll 30, or another curved axis roll before the compensating roll 30, to the pleating roll 40, or another succeeding curved axis roll. Although the plane of the axis of the compensating roll 30 may have any one of several orientations relative to the plane of the axis of the pleating roll 40, depending upon the radii of curvature and span between these rolls 30 and 40, the apparatus 15 is generally simplified if such planes are generally parallel.

The radius of curvature $R_C$ of the compensating roll 30 and the distance Span (DE)" between the ends 32 of the compensating roll 30 and the ends 42 of the pleating roll 40 are parameters, also, adjusted as appropriate, to cause substantial equalization of the paths of travel of transversely corresponding points on the lamina 10. These two adjusted parameters are not independent, and should be jointly adjusted, in concert with the planes defined by the axes of the pleating an compensating rolls 30, to provide the aforementioned equalization of the paths of travel.

The apparatus 15 may further comprise one or more straight axis rolls 20 or 50. One straight axis roll 20 may be disposed before and generally parallel the compensating roll 30 and one straight axis roll 50 may be disposed after and generally parallel the pleating roll 40. The two straight axis rolls 20 and 50 define two additional spans of the path of travel of the lamina 10 through the apparatus 15.

THE APPARATUS GEOMETRY

At the outset, to select the geometry of the apparatus 15, including the radii of curvature and the relative spacing of the pleating and compensating rolls 40 and 30, and any additional rolls which may be desired, one first ascertains the radius of curvature of the pleating roll 40, and the distance Span (DE)" between the ends 42 of the pleating roll 40 and the component immediately before the pleating roll 40 (e.g., the compensating roll 30), based on the constraints of the desired pleated lamina 10.

To select the desired radius of curvature of the pleating roll 40, one ascertains the unpleated width of the lamina 10 UPW (i.e., the original width of the lamina 10), the pleated width PW of the lamina 10, and the difference between the pleated width PW and the unpleated width UPW of the lamina 10. Although many known techniques are available for specifying the pleated width PW of the lamina 10, generally, as used herein, the pleated width PW of the lamina 10 is the cross machine direction distance of the line through the corrugated nip and contacting the free ends of the lands 46 and 66 of the pleating roll 40 and complementary interdigitating roll 60, which line has a length generally equivalent the unpleated width UPW of the lamina 10.

Then, as described below, a radius of curvature $R_p$ for the pleating roll 40 and the resultant distance Span (DE)" between the ends 42 of the pleating roll 40 and the adjacent component of the apparatus 15 immediately before the pleating roll 40, particularly the ends 32 of the compensating roll 30, are selected in any combination which provides the desired cross machine directional collapse of the lamina 10 from the unpleated width UPW of the lamina 10 to the pleated width PW of the lamina 10.

There are many feasible combinations of such distances Span (DE)" and radii of curvature $R_p$ which mathematically produce the desired collapse of the lamina 10 from the unpleated width UPW to the pleated width PW. Any particular combination which is suitable for the particular apparatus 15 under development may be selected.

The ends 32 and 42 of the curved pleating and compensating rolls 30 and 40 are considered to be fixed in the machine direction for the described method of calculating the pleating roll 40 radius of curvature $R_p$, the distance Span (DE)" between the ends 42 of the pleating roll 40 and ends 32 of the compensating roll 30, and the subsequent calculations. Components are considered to be "fixed" when there is no relative change in the positions of such components. The ends of the rolls provide a reference point from which measurements, such as Spans (XY)" between the ends of the rolls, of the apparatus 15 geometry may be taken, and are useable for both straight axis and curved axis rolls, wherein X and Y refer to points on the ends of any roll under consideration. Either or both of the radius of curvature $R_p$ of the pleating roll 40 and the angle of the plane defined by the axis of the pleating roll 40 are adjusted, as described below, to achieve the desired pleated lamina 10 geometry.

Once the radius of curvature $R_p$ of the pleating roll 40 and the distance Span (DE)" between the ends 42 of the pleating roll 40 and ends 32 of the compensating roll 30 are selected in any combination which provides for the desired amount of lateral collapsing of the lamina 10, either or both of the radius of curvature $R_C$ of the compensating roll 30 and the angle of the plane of the stationary axis of the compensating roll 30 are adjusted to provide for substantial equalization of the paths of travel through the apparatus 15 of any points on the lamina 10. Generally, as the radius of curvature $R_p$ of the pleating roll 40 is decreased or as the distance Span (DE)" between the compensating roll 30 and the pleating roll 40 is increased, greater lateral collapsing of the lamina 10 will occur and the pleated width PW of the lamina 10 will become smaller.

Associated with each curved axis roll is a linear measurement referred to as the bow. The "bow" is the difference in machine direction position between two points along the axis of a curved axis roll and within the plane of the axis of a such roll. More particularly, as used herein the bow at any point of the axis of a curved axis roll is the difference in machine direction position between the ends of the axis of the roll and another point on the axis.

As used herein, generally, the "centerline" of any roll, either straight or curved, is the line parallel to the machine direction, located between and generally equidistant from the ends of the roll, and which perpendicularly bisects the chord of the axis of the roll. It will be apparent that at the centerline of the roll, the bow of this roll is maximized, and at the ends of the roll the bow is 0 centimeters. It will be apparent that for a straight axis roll having an infinite radius of curvature, the bow is 0 centimeters throughout the axial length of the roll.

The radius of curvature and bow of a roll are inversely proportional. The maximum bow for a particular curved axis roll is the machine direction dimension between the fixed ends of such curved axis roll and the centerline of the roll. This maximum bow is designated "$Bow_C$" in reference to the compensating roll 30 and "$Bow_{p''}$" in reference to the pleating roll 40. A lesser bow occurs at either edge 12 of the lamina 10. The difference in machine direction position between the ends 32 of the compensating roll 30 and the edge 12 of the lamina 10 on the compensating roll is designated "$Bow_C$" and the difference in machine direction position between the ends 42 of the pleating roll 40 and the edge 12 of the lamina 10 on the pleating roll 40 is designated "$Bow_{p'}$."

Orthogonal the bow is a cross machine direction measurement of the roll referred to as the chord of the roll. Both curved axis rolls and straight axis rolls have a chord, however specifically the chord of a curved axis roll is of significance for the illustrative calculations described herein. The "chord" is the linear distance between the ends 32, 42 or 62 of the axis of a curved axis roll 30, 40 or 60 and are respectively designated "$Chord_C$" and "$Chord_p$" for the compensating and pleating rolls 30 and 40, respectively. The designer selects the chords for the pleating roll 40 and the compensating roll 30 based on the constraints imposed by the pleated and unpleated widths PW and UPW of the lamina 10. The chords of the pleating and compensating rolls 30 and 40 may be equal and should be about 50 percent greater than the unpleated width UPW of the lamina 10, to allow for tracking variations in the cross machine direction.

THE CALCULATIONS

The radius of curvature $R_p$ of the pleating roll 40 and the distance Span (DE)" from the ends 32 of the compensating roll 30 to the ends 42 of the pleating roll 40 are found as follows. As noted above, the unpleated width UPW and the pleated width PW are known constraints, based upon the desired finished product.

The designer also selects a maximum bow for the pleating roll 40 and for the compensating roll 30. Each maximum bow should be less than about 1.9 centimeters (0.75 inches), so that a commercially available curved axis roll, such as the type sold by the Mount Hope Company of Taunton, Mass., may be used with the addition of a rotatable grooved sleeve. Theoretically, there is no lower limit on the bow, but typically the curved axis rolls have a bow of at least about 0.6 centimeters (0.25 inches). For the initial trial, a reasonable value for the maximum bow $Bow_{p''}$ and $Bow_{C''}$ of both the pleating and compensating rolls 30 is about 1.3 centimeters (0.5 inches). A maximum bow of this magnitude allows for adjustment towards either end of the range, as desired.

Knowing the chord and maximum bow of the proposed compensating and pleating rolls 30 and 40, the radii of curvature $R_C$ and $R_p$ of the compensating and pleating rolls 30 and 40, respectively, may be found according to the general formulae:

$$Chord_C = Chord_p = 1.5\ UPW$$

$$R_C = Chord_C \times \{[1 + 4(Bow_{C''}/Chord_C)^2]/[8(Bow_{C''}/Chord_C)]\},$$

$$R_p = Chord_p \times \{[1 + 4(Bow_{p''}/Chord_p)^2]/[8(Bow_{p''}/Chord_p)]\},$$

wherein $R_C$ and $R_p$ are the radii of curvature of the particular roll under consideration, $Bow_X$ is the maximum bow of such roll (the machine direction distance with the plane of the axis from the centerline to the fixed ends of that roll), and $Chord_X$ is the cross machine direction distance between the ends of this roll. The subscript X, of course, designates any roll under consideration.

The axes of the pleating and compensating rolls 40 and 30 should be generally parallel, based upon the parallelism of the lines tangent to the apexes of the axes, as noted above. The relative spatial position Span (DE)" between the fixed ends 42 of pleating roll 40 and the ends 32 of the compensating roll 30 is important and found as described below.

Knowing the radius of curvature $R_p$ of the pleating roll 40, the bows $Bow_C$ and $Bow_{p'}$ of the compensating and pleating rolls 30 and 40 at the edge 12 of the lamina 10 and the pleated and unpleated widths PW and UPW of the lamina 10, the distance from the ends 32 of the compensating roll 30 to the ends 42 of the pleating roll 40 may be found according to the formula:

$$Span\ (DE)'' = [((UPW - PW)/2)/Tan\theta] + Bow_{p'} - Bow_C,$$

wherein $\theta$ is the angular deviation of the edge 12 of the lamina 10 from the machine direction and is given by the formula:

$$\theta = Arcsin[(PW/2)/R_p]$$

Knowing the radii of curvature $R_p$ and $R_C$ of the pleating and compensating rolls 40 and 30, the included angle between the planes defined by the axes of the pleating and compensating rolls 40 and 30, and the Span (DE)" between the ends 32 and 42 of the pleating and compensating rolls 30 and 40, the geometry and spatial disposition of these rolls 30 and 40 are fully determined. However, it is necessary to verify that substantial equalization of the paths of travel of transversely corresponding points has been achieved.

To achieve equalization of the travel of any points on the lamina 10 between the compensating and pleating rolls 30 and 40, it is necessary to balance the path of travel of transversely corresponding points on the lamina 10 by adjusting the angle of the plane of the compensating roll 30 relative to the angle of the plane of the pleating roll 40 and adjusting the radius of curvature $R_C$ of the compensating roll 30 relative to the radius of curvature $R_p$ of the pleating roll 40. The planes defined by the axes of the rolls are preferably mutually parallel, eliminating one variable from the required calculations. Further simplification occurs if the point of tangency E of the lamina 10 on the pleating roll 40 is generally coplanar of the point D from which the lamina 10 exits the compensating roll 30 and the planes defined by the curved axes of the pleating and compensating rolls 40 and 30.

If substantial equalization has not been achieved in the initial geometry, it is possible to adjust the radius of curvature $R_C$ of the compensating roll 30 to achieve equalization of the path of travel of the lamina 10 through the apparatus 15. If substantial equalization is achieved by adjusting the radius of curvature $R_C$ of the compensating roll 30, the new pleated width PW of the lamina 10 is verified to be acceptable. If this new pleated width PW of the lamina 10 is unacceptable, the distance Span (DE)" from the compensating roll 30 to the pleating roll 40, is adjusted, as necessary, in an iterative fashion with the radius of curvature $R_C$ of the compensating roll 30.

PATH OF TRAVEL VERIFICATION

The path of travel verification is performed by calculating the aggregates of the paths of travel of two transversely corresponding points on the lamina 10 as it travels through the apparatus 15. While such verification may be performed using almost any two transversely corresponding points, preferred points are transversely spaced relatively far apart on the lamina 10, so that any potential error, i.e. difference between the aggregates, is generally maximized, and hence more noticeable. Two particularly preferred points are those found at either outboard edge 12 of the lamina 10 and at the centerline of the lamina 10. Typically, these points represent the maximum deviation in the path of travel between various transversely corresponding points on the lamina 10. Therefore, if the aggregate of the paths of travel of these points are substantially equalized, any intermediate points should also have a substantially equivalent path of travel. This occurs because typically the aggregate of the paths of travel of any intermediate points have a magnitude between the magnitudes of the aggregate of the path of travel of the outboard edges 12 of the lamina 10 and the aggregate of the path of travel of the centerline of the lamina 10.

It will be apparent to one skilled in the art that the calculations for determining the roll geometries and placement may be conveniently considered as the aggregate of two paths of travel between common transversely corresponding points (e.g., the paths of travel) of the center of the lamina 10 and of outboard edges 12 of the lamina 10. To facilitate such consideration, two straight axis rolls 20 and 50 may be provided and disposed parallel and outboard of the curved axis pleating and compensating rolls 40 and 30, with one straight axis roll 20 upstream of the compensating roll 30 and one straight axis roll 50 downstream of the pleating roll 40, such that the first straight axis roll 20 is before the compensating roll 30, and the pleating roll 40 is before the second straight axis roll 50.

Referring to FIG. 6, the two straight axis rolls 20 and 50 may be disposed in any manner such that each straight axis roll 20 and 50 is outboard of the pleating and compensating rolls 40 and 30, i.e. neither straight axis roll 20 or 50 is between the pleating and compensating rolls 40 and 30, and the axes of all four rolls 20, 30, 40 and 50 are mutually parallel. More particularly, the calculations are simplified if the ends 52 of the straight axis roll 50 disposed after the pleating roll 40 is coplanar of the ends 32 and 42 of the pleating roll 40 and the compensating roll 30.

It is, however, necessary that the lamina 10 at least partially wrap the compensating roll 30, so that a difference in path length at the lamina 10 centerline may be introduced by the compensating roll 30. Thus, the straight axis roll 20 before the compensating roll 30 is preferably not coplanar of the other three rolls 30, 40 and 50, but rather is preferably disposed opposite the face of the compensating roll 30 which the lamina 10 traverses upon exiting such roll—so that a relatively greater angle of wrap around the compensating roll 30 occurs. Furthermore, the lamina 10 should not be fed directly from a parent spool of material (not shown) to the compensating roll 30, because the reduction in diameter of such spool, which occurs as the material of the spool becomes depleted, may introduce serious error to the path of travel verification.

It will be apparent that if the second straight axis roll 50 is not explicitly included, as shown to by a dedicated, separate component, another component may be used in place of the second straight axis roll 50 for the path of travel verification. For example, if the lamina 10 is to enter a converting operation, a nip, rotary knife or other component may be utilized as a reference to compare transversely corresponding points in place of the second straight axis roll 50. It is generally undesirable to wind the pleated lamina 10 directly onto a take-up spool, as the pleat definition will not be maintained for a nonrigid lamina 10 without a means, as described below, to maintain the pleat definition.

While the addition of two straight axis rolls 20 and 50 somewhat increases the number of calculations to be performed, one skilled in the art may appreciate the convenience of aggregating the paths of travel between common transversely corresponding points. Each straight axis roll 20 or 50 is a means for causing registry within the apparatus 15 of transversely corresponding points on the lamina 10. It will be apparent to one skilled in the art that other straight axis rolls may be interposed in the apparatus 15, if desired, to facilitate the calculations. The calculations may be simplified if points of tangency D, E and F of the lamina 10 on the compensating roll 30, pleating roll 40 and second straight axis roll 50 are generally coplanar.

More particularly, this verification is accomplished by aggregating the lengths of the paths of travel of the two selected points through the apparatus 15 to find the total path of travel of such point through the apparatus 15. Generally, the total path of travel of any point on the lamina 10 is the aggregate of three separate spans of travel: the distance Span (BC)" from the first straight axis roll 20 to the compensating roll 30, the distance Span (DE)" from the compensating roll 30 to the pleating roll 40, and the distance Span (EF)" from the pleating roll 40 to the second straight axis roll 50; plus any intermediate wraps of the lamina 10 about the rolls between such spans: the wrap (AB) around the first straight axis roll 20, the wrap (CD) around the compensating roll 30, the wrap around the pleating roll 40, and the wrap around the second straight axis roll 50. The illustrated embodiment has no wrap of the lamina 10 about either the pleating roll 40 or about the second straight axis roll 50, although it will be apparent that such wraps may be included, if desired, for a particular embodiment.

As used herein, "wrap" refers to the distance around the circumference of a roll which a lamina 10 travels and is bounded by and between two points of tangency, an entrance point of tangency and an exit point of tangency. The "entrance tangent point" is the position on the circumference of any cross section of a roll first encountered by the lamina 10 as it passes through the apparatus 15. Likewise, the "exit tangent point" is the position on the circumference of any cross section of a roll last encountered by the lamina 10 as it passes through the apparatus 15.

Typically, two parallel and independent calculations are performed, one for the edge 12 of the lamina 10 and one for the center of the lamina 10. With continuing reference to FIG. 6, the first calculation below is the path of travel of a point on the edge 12 of the lamina 10. The second calculation below is the path of travel of a point on the centerline of the lamina 10.

To calculate the length of the path of travel from the first straight axis roll 20 to the compensating roll 30, one first considers the path of travel of a point on either outboard edge 12 of the lamina 10. As generally noted above, and specifically for the embodiment of FIGS. 5 and 6, this path is the aggregate of the length of the wrap (AB)' of the lamina 10 about the first straight axis roll 20, the distance span (BC)' between the exit point of tangency B' of the first straight axis roll 20 to the entrance point of tangency C' of the compensating roll 30, the length of the wrap (CD)' of the lamina 10 about the compensating roll 30, the distance span (DE)' from the compensating roll 30 to the pleating roll 40 and the distance span (EF) from the pleating roll 40 to the second straight axis roll 50. Computations of the wrap around the pleating and second straight axis rolls 40 and 50 are omitted and not shown in the figures because the lamina 10 intercepts such rolls 40 and 50 only at a point of tangency, yielding a zero magnitude for the path of travel of such wrap.

To calculate the (AB)' around the first straight axis roll 20, the entrance points of tangency are designated A' and B' respectively, and the wrap (AB)'. Tangent point A' is the entrance point of lamina 10 on the first straight axis roll 20, is preferably coincident with the vertical and in the 6:00 position of the p e view of FIG. 6. Tangent point B' is the exit point of lamina 10 from the first straight axis roll 20 and is prefer the horizontal, i.e. in one of the lower quadrants of the of this roll 20. Angle $\gamma_{FS'}$ is the subtended angle between the entrance and exit tangent points A' and B'. The wrap (AB)' of the lamina 10 around this roll 20, or any roll, is generally the radius of the roll (at the cross section registered with an edge of the laminate) multiplied by the subtended angle of wrap, measured in radians. Algebraically this may be expressed as:

$$(AB)' = (Dia_{FS'}/2) \times \gamma_{FS'}$$

wherein $Dia_{FS'}$ is the diameter of the first straight axis roll 20 at the cross section registered with the edge 12 of the lamina 10 and $\gamma_{FS'}$ is the sub of wrap at this cross section measured in radians.

The length of t of travel of the span (BC)' between the first straight axis roll 20 and the compensating roll 30 is the distance from the exit point of tangency B' on the first straight axis roll 20 to entrance point of tangency C' where the lamina 10 first intercepts the compensating roll 30, and is designated (BC)'.

The distance (BC)' the exit tangent point B' of the first straight axis roll to the entrance tangent point C' of the compensating roll found from the distances between center M' of the first s axis roll 20 and the center of the compensating roll 30. The horizontal and vertical differences in positions of the centers these rolls 20 and 30 are respectively designated the horizontal and vertical offset.

The length of path (BC)' is parallel to and equal in length to the line (MN)', which extends from point M', the center of the first straight axis 20 to point N'. Point N' is the intersection of the radius from the center of the compensating roll 30 to the entrance point of tangency C', and the perpendicular to such radius which passes through the center M' of the first straight axis 20.

Line (MN)' may be thought of as the leg of a right triangle which has as its hypotenuse the line connecting the center M' of the first straight axis 20 and the center of the compensating roll 30, and as the other leg the portion of the radius from the center of the compensating roll 30 to point N'. The length of this radius portion is absolute value of one half of the difference between the diameters of the compensating roll 30 and the first straight axis and is given by the formula:

$$Radius\ Portion\ Length = |(Dia_C - Dia_{FS'})/2|$$

wherein $Dia_C$ and $Dia_{FS'}$ are the diameters of the compensating roll 30 and the first straight axis roll 20, respectively, at a cross section registered with the edge 12 of the lamina 10. The hypotenuse is the square root of the sum of the squares of the horizontal and vertical offsets, after accounting for the machine direction difference in $Bow_C$ between the ends 32 of the compensating roll 30 and the edge 12 of the lamina 10.

Under the Pythagorean length (MN)' and hence (BC)' is the square root of the hypotenuse squared minus the other leg squared. Algebraically this be expressed as:

$$(BC)' = (MN)' = \{[horizontal\ offset + Bow_C)^2 + (vertical\ offset)^2]^{\frac{1}{2}} - [|(Dia_C - Dia_{FS'})/2|]^2\}^{178}$$

The length of the (CD)′ around the compensating roll 30 extends from the entrance point of tangency C′, where the lamina 10 first intercepts the compensating roll 30 to the exit point of tangency D′, where the lamina 10 leaves the compensating roll 30. The subtended angle between the entrance and exit points of tangency C′ and D′ is $\gamma_{C'}$. The length of the wrap of an edge 12 of the lamina 10 around the compensating roll 30 is found in a manner similar to that described above and is given by the algebraic formula:

$$(CD)' = (Dia_{C'}/2) \times \gamma_{C'}$$

wherein $Dia_{C'}$ is the diameter of the compensating roll 30 at the cross section registered with the edge 12 of the lamina 10 and $\gamma_{C'}$ is the subtended angle of wrap at this cross section, measured in radians.

Note that if difficulty is encountered measuring the angle of wrap $\gamma_{FS'}$ around the firs axis roll 20 or the angle of wrap $\gamma_{C'}$ around the compensating roll 30, such angles may advantageously be found, as follows, by using the relationship between the centers of first straight axis roll 20 and the compensating roll 30. It will be apparent to one skilled in the art that the angle of wrap $\gamma_{FS'}$ around the first straight axis roll 20 is equivalent supplement of the angle of wrap $\gamma_{C'}$ around the compensating roll 30. Algebraically this may be expressed as:

$$\gamma_{FS'} = 180° - \gamma_{C'} \text{ and } \gamma_{C'} = 180° - \gamma_{FS'}$$

However, $\gamma_{C'}$ is the of two angles, the angular deviation of the line connecting the centers of the first straight axis roll 20 and compensating roll 30, and the angular deviation from this line to the line connecting the center M of the first straight roll to point N on the radius of the compensating roll 30 which intercepts the entrance tangent point C of the lamina 10. Algebraically, this may be as:

$$\gamma_{C'} = 90° + Arctan\{(horizontal\ offset + Bow_{C'})/vertical\ offset\}' Arcsin\{[|(Dia_{C'} - Dia_{FS'})/2|]/[(horizontal\ offset + Bow_{C'})^2 + (vertical\ offset)^2]^{\frac{1}{2}}\}$$

and from which $Y_{FS'}$ is easily found as shown above.

Referring back to FIG. 5, the span (DE)′ between the exit point of tangency D′ of an edge 12 of the lamina 10 on the compensating roll 30 and entrance point of tangency E′ on the pleating roll 40 is also found according to the Pythagorean theorem. The path of travel of a point on the edge 12 of the lamina 10 from the compensating roll 30 to the pleating roll 40 is the hypotenuse of a triangle. It will be apparent to one skilled in the art, that the first leg of this triangle represents the cross machine direction path of travel of the edge 12 of the lamina 10 and the leg of this triangle represents the machine direction path of travel of the edge 12 of the lamina 10. The first leg of this is one-half of the difference between the pleated and unpleated widths PW and UPW of the lamina 10, and the other leg of this triangle is the machine direction distance, at the edge 12 of the lamina 10 between the points of tangency D′ and E′ of the compensating and pleating rolls 30 and 40.

The first leg is one-half of the difference between the unpleated width UPW and pleated width PW of the lamina 10. The second leg is the a of the machine direction distance between the ends of the two rolls Span (DE)″ plus the difference in machine direction position $Bow_{C'}$ between the compensating roll 30 exit tangent point D′ the ends 32 of the compensating roll 30, minus the difference in machine direction position $Bow_{p'}$ between the ends 42 of the roll 40 and the pleating roll 40 entrance tangent point E′. Algebraically this is expressed as:

$$(DE)' = \{[Span\ (DE)'' + Bow_{C'} - Bow_{p'}]^2 + [(UPW - PW)/2]^2\}^{\frac{1}{2}}$$

wherein Span (DE)″ is the machine direction distance between the ends 42 of the pleating roll 40 and the ends 32 of the compensating roll 30.

The second straight roll 50 may be disposed such that the point of tangency of the lamina 10 is in substantially the same plane, preferentially the horizontal plane, as the exit point of tangency E′ of the lamina 10 on the pleating roll 40. It will be apparent that for the embodiment of FIG. 6, the pleating roll 40 entrance tangent points E and E′ are coincident the exit tangent points E and E′ of the pleating roll 40. It is to be recognized that a small amount of transverse collapsing of the lamina 10 may occur throughout the span (EF)′ from the pleating roll 40 to the compensating roll 30. However, such collapse is usually insignificant in magnitude and may be ignored without interjecting significant error into the path of travel verification.

Thus, the span (EF)′ from the exit point of tangency E′ of the lamina 10 on the pleating roll 40, to the entrance point of tangency F′ on the second axis roll 50, does not have a significant vector component of travel in the cross machine direction.

Therefore, the path of travel any point on the outboard edge 12 of the lamina 10 the pleating roll 40 to the second straight axis roll 50 is substantially equal the machine direction distance Span (EF)″ between the ends 42 of the pleating roll 40 and the ends 52 of the second straight axis roll 50, plus the difference $Bow_{p'}$ in machine direction position between the ends 42 of the pleating roll 40 and the centerline of the pleating roll 40 at the edge 12 of the lamina 10. Algebraically this may be expressed as:

$$(EF)' = Span\ (EF)'' + Bow_{p'}$$

It will be apparent to one skilled in the art, that if the point of tangency F′ of second straight axis roll 50 is noncoplanar of the point tangency E′ of the pleating roll 40, or if any wrapping of the second straight axis roll 50 occurs, a calculation similar to that described above to determine the length of the path of travel span (BC)′ from the first straight axis roll 20 to the compensating roll 30 is necessary. It is generally preferred that the span (EF)′ from the pleating roll 40 to the second straight axis roll 50 be less than about 20 centimeters (7.9 inches that diminution in height of the pleat or other significant loss of the pleats does not occur.

The path of travel (AF)′ of either outboard edge 12 of the lamina 10 through the apparatus 15 is the aggregate of the paths of travel of the three spans (BC)′, (DE)′ and (EF)′ between the rolls and the intermediate (AB)′ and (CD)′ around the rolls. Algebraically this may be as:

$$(AF)' = (AB)' + (BC)' + (CD) + (DE)' + (EF)'$$

The above described verification is repeated for the path of travel of a point on the centerline of the lamina 10. A point traveling through apparatus 15 along the centerline of the lamina 10 does not more than a minimal component of travel in the cross machine direction. As noted above, the aggregate of the paths of travel of a point on the center of the lamina 10 is also the aggregate of three separate spans of travel: the span (BC) from the first straight axis roll 20 to the compensating roll 30, the span (DE) from the compensating roll 30 to the pleating roll 40, and the span (EF) from the pleating roll 40 to the second straight axis roll 50; and the intermediate wraps (AB) and (CD) of rolls between such spans (BC), (DE), and (EF).

As described above, the first component of the path of travel of a point on the centerline of the lamina 10 is the wrap (AB) around the first straight axis roll 20 and is the radius of the roll multiplied by the subtended angle of wrap, both parameters being measured at the cross section of the roll registered with the centerline of the lamina 10. Algebraically this may be expressed as:

$$(AB)=Dia_{FS}/2\times\gamma_{FS}$$

wherein $\gamma_{FS}$ is measured in radians and may be found according to the formula:

$$\gamma_{FS}=90-Arctan\{(horizontal\ offset+Bow_{C''})/vertical\ offset\}-Arcsin\{[|(Dia_C-Dia_{FS})/2|]/[(horizontal\ offset+Bow_{C''})^2+(vertical\ offset)^2]^{\frac{1}{2}}\}$$

The second component of travel (BC) is the centerline distance from exit point of tangency B of the first straight axis roll 20 to the entrance point of tangency C of the compensating roll 30. This is generally equivalent to span (BC)' determined above, although the increase in bow $Bow_C$ between the edge 12 of the lamina 10 and the centerline $Bow_{C''}$ of the lamina 10 must be taken into account. Algebraically, this is given by the formula:

$$(BC)=(MN)=\{[(horizontal\ offset+Bow_{C''})^2+(vertical\ offset)^2]^{\frac{1}{2}}-[|(Dia_C-Dia_{FS})/2|]^2\}^{\frac{1}{2}}$$

The third component of travel (CD) is the wrap of the lamina 10 around the compensating roll 30 and, as noted above is the radius of the compensating roll 30 multiplied by the subtended angle of wrap, both parameters being measured at the cross section of the roll registered with the centerline of the lamina 10. Algebraically this is given by:

$$(CD)=(Dia_C/2)\times\gamma_C$$

The fourth component of the path of travel of a point on the centerline of the lamina 10 is the distance (DE) from the exit point of tangency D on the compensating roll 30 to the entrance point of tangency E on the pleating roll 40. This span (DE) is the machine direction distance between the centerlines of the compensating roll 30 and the pleating roll 40 and is equivalent to the aggregate of the distance Span (DE)" between the fixed ends 32 and 42 of the pleating and compensating rolls 30 and 40, plus the difference in machine direction position $Bow_{C''}$ between the ends 32 and centerline of the compensating roll 30 minus the difference in the machine direction position $Bow_p''$ between the ends 42 and centerline of the pleating roll 40. Algebraically this may be expressed as:

$$(DE)=Span\ (DE)''+Bow_{C''}-Bow_p''$$

The fifth component of the path of travel of a point on the centerline of the lamina 10 is the distance (EF) from the exit point of tangency E on the pleating roll 40 to the entrance point of tangency F on the second straight axis roll 50. As noted above, the entrance and exit tangent points E and F of each of these rolls 40 and 50 are coincident, because the lamina 10 intercepts each roll 40 or 50 only at a single point of tangency E or F. At the centerline of the lamina this span is the aggregate of the distance between the ends 42 and 52 of the pleating and second straight axis rolls 40 and 50 Span (EF)" plus the machine direction distance $Bow_p''$ between the centerline and ends 42 of the pleating roll 40. Algebraically this may be expressed as:

$$(EF)=Span\ (EF)''+Bow_p''$$

Thus, the path of travel (AF) of the centerline of the lamina 10 through the apparatus 15 is the aggregate of the paths of travel of the three spans (BC), (DE) and (EF) discussed above and the intermediate wraps (AB) and (CD) around the rolls. Algebraically this may be expressed as:

$$(AF)=(AB)+(BC)+(CD)+(DE)+(EF)$$

ITERATIONS

The aggregated path of travel (AF)' of an edge 12 of the lamina 10 and the aggregated path of travel (AF) of the centerline of the lamina 10 (and the aggregated path of travel of any other points on the lamina) are compared. If the aggregated path of travel (AF) at the centerline of the lamina 10 is greater than the aggregated path of travel (AF)' at the edge 12 of the lamina 10, compensation may be effected by either increasing the distance Span (DE)" between the compensating and pleating rolls 30 and 40 or, more preferably, by decreasing the radius of curvature $R_C$ of the compensating roll 30. Conversely, if the aggregated path of travel (AF)' at an edge 12 of the lamina 10 is greater than the aggregated path of travel (AF) at the centerline of the lamina 10, compensation may be effected by either decreasing the distance Span (DE)" between the compensating and pleating rolls 30 and 40 or, preferably, by increasing the radius of curvature $R_C$ of the compensating roll 30.

Once a new radius of curvature RC for the compensating roll 30 and/or a new distance Span (DE)" between the ends 32 and 42 of the compensating and pleating rolls 30 and 40 are selected, the path verification described above should be repeated. A new difference between the aggregated paths of travel (AF)' and (AF) of the edge 12 and centerline (and any intermediate points) is ascertained. If this difference is too great, a revised distance Span (DE)" between the ends 32 and 42 of the compensating and pleating rolls 30 and 40 and a revised pleating roll 40 radius of curvature $R_p$ (and to a lesser extent the compensating roll 30 radius of curvature $R_C$) are tailored, as described above, and the process is repeated.

It should be recognized that the pleated width PW of the lamina 10 changes according to adjustment in the radius of curvature $R_C$ of the compensating roll 30 and the distance Span (DE)" between the ends 32 and 42 of the compensating and pleating rolls 30 and 40. Generally the pleated width PW of the lamina 10 increases as the radii of curvature $R_p$ and $R_C$ of the pleating and compensating rolls 30 and 40 increases or the distance Span (DE)" between the ends 32 and 42 of the compensating and pleating rolls 30 and 40 decreases.

Therefore, if the actual pleated width PW of the lamina 10 is critical, the actual pleated width PW of the lamina 10 should be determined, using known techniques, as described above, using the revised radius of curvature $R_C$ of the compensating roll 30 and revised distance Span (DE)" between the compensating and pleating rolls 30 and 40. If the revised pleated width PW of the lamina 10 is unacceptable, or is a critical parameter, the pleated width PW of the lamina 10 may be selected as an independent variable, the distance Span (DE)" between the ends 32 and 42 of the pleating and compensating rolls 30 and 40 and the radius of curvature $R_C$ of the compensating roll 30 are adjusted as necessary, and the aggregated paths of travel (AF) and (AF)' of various points on the lamina 10 recalculated.

The process may be repeated, as many times as necessary until the aggregated paths of travel (AF) and (AF)' converge on the same value (for an acceptable pleated width PW). Typically a difference in the aggregated paths of travel (AF) and (AF)' between the centerline and edge 12 of the lamina 10 of less than about 0.00004 millimeters (0.001 inches) is desired and suitable, as any smaller difference is beyond the resolution of most commercially available hardware. A mathematical path difference of less than about 0.5 percent of the shorter aggregated path of travel (AF) or (AF)' can typically be obtained in 5–6 iterations. It will be apparent to one skilled in the art that such iterations may be advantageously programmed onto a computer, to simplify the repetitive nature of the iterative calculations.

Several factors may introduce error into the calculations of the path of travel for the illustrated apparatus 15 or an apparatus 15 having any other desired configuration. For example, while the wrap (CD)' of the edge 12 of the lamina 10 around the compensating roll 30 has been described as circumferential and orthogonal the axis of the compensating roll 30, such wrap (CD)' is somewhat more helix shaped. The helix has a cross machine direction component of travel which may easily be accounted for by one skilled in the art if further accuracy is desired. The lamina 10 has been considered inextensible, when, in fact, some stretching of the lamina 10 may occur. However, the error introduced by this factor is typically very small and may be ignored without adverse effects on the pleated lamina 10.

The above-described algorithm is directed only to the centerline and edge 12 of the lamina 10. As noted above, generally it is not necessary to consider other points on the lamina 10 intermediate the center and edge 12 of the lamina 10. If the aggregate of the paths of travel (AF) and (AF)' between the two straight axis rolls 20 and 50 are substantially equalized for the centerline and edge 12 of the lamina 10, the aggregate of the paths of travel of any intermediate points will typically be substantially equalized to a like degree.

If it is desired to compute the aggregate of the paths of travel of an intermediate point, a suggested intermediate point is either point which is at the bisection of either cross machine direction line connecting the centerline of the lamina 10 to the edge 12 of the lamina 10. These two points are about one-half of the cross machine direction distance between the centerline and edges 12 of the lamina 10, are referred to as the "midpoints" and may be used, if desired, to further check the accuracy of the apparatus 15 in producing substantially equal aggregates of paths of travel (AF) and (AF)' of the lamina 10. Each midpoint of the lamina 10 has a vector component of travel in the cross machine direction as the lamina 10 proceeds through the apparatus 15.

EXAMPLE I

It is desired to manufacture a pleated lamina 10 from a material about 0.20 millimeters (0.008 inches) in thickness. It is desired that such pleated lamina have about 35 pleats of about 2.4 millimeters (0.094 inches) in height on a spacing of about one pleat per centimeter (4 pleats per inch). Using known techniques, it is apparent to one skilled in the art that such a lamina 10 has a pleated width PW of about 22.3 centimeters (8.78 inches) and an unpleated width UPW of about 32.4 centimeters (12.75 inches). Such a lamina 10 is satisfactorily produced using the apparatus 15 of FIGS. 2–6 particularly an apparatus having a pleating roll 40 used in conjunction with an interdigitating roll 60.

The selected apparatus 15 has a pleating roll 40 with a diameter of about 5.7 centimeters (2.25 inches) measured at the outer circumference of the lands 46. The grooves 44 are about 4.8 millimeters (0.188 inches) in width, about 4.8 millimeters (0.188 inches) in depth and spaced on a pitch of about 6.4 millimeters (0.25) inches). The pleating roll 40 has a radius of curvature $R_p$ of about 2.55 meters (100.3 inches) providing a bow $Bow_{p''}$ at the centerline of about 12.7 millimeters (0.500 inches), a bow $Bow_{p'}$ at the outboard edges 12 of the lamina 10 of about 10.3 millimeters (0.404 inches) and a bow at the midpoint of the lamina 10 of about 12.2 millimeters (0.479 inches).

A complementary interdigitating roll 60, axially offset about one-half pitch in the cross machine direction, is provided. The circular lands 66 of the interdigitating roll 60 enter the grooves 44 of the pleating roll 40 has a radial distance of about 2.39 millimeters (0.094 inches) to provide the desired pleat height.

A compensating roll 30 is provided, before and in series with the pleating and interdigitating rolls 40 and 60, to substantially equalize the aggregated paths of travel (AF) and (AF)' of the points on the centerline, midpoints and edges 12 of the lamina 10. The compensating roll 30 has a diameter of about 3.8 centimeters (1.5 inches) and a radius of curvature $R_C$ of about 20.49 meters (806.5 inches) yielding a bow $Bow_{C''}$ at the centerline of the lamina of about 1.6 millimeters (0.062 inches) the midpoints of the lamina of about 1.4 millimeters (0.056 inches) an a bow $Bow_C$ at the outboard edge 12 of the lamina 10 of about 0.9 millimeters (0.037 inches). The compensating roll 30 is fixed so that the exit point of tangency D of the lamina 10 is disposed in about the same plane as the point of tangency E of the pleating roll 40, and with a distance Span (DE)", between the ends 32 and 42 of the pleating and compensating rolls 30 and 40 of about 111.53 centimeters (45.38 inches).

Two straight axis rolls 20 and 50 are disposed outboard of and in series with the pleating and compensating rolls 30 and 40. The first straight axis roll 20 is disposed with vertical and horizontal offsets, each about 25.4 centimeters (10 inches), so that the first straight axis roll 20 is vertically below and horizontally toward the pleating roll 40—relative to the compensating roll 30. The first straight axis roll 20 has a diameter of about 2.54 centimeters (1 inch). The second straight axis roll 50 has a diameter of about 5.72 centimeters (2.25 inches). The second straight axis roll 50 is disposed about 12.7 centimeters (5 inches) from and after the pleating roll 40 and with the points of tangency D, E, and F in about the same horizontal plane.

The apparatus 15 of Example 1 produced the results illustrated in Table which presents 3 columns. The first column is the path of travel (AF)' of either of the two edges 12 of the lamina 10. The second column is the path of travel of either of the two midpoints of the lamina 10, which midpoints are about halfway between the corresponding edge 12 of the lamina 10 and the centerline of the lamina 10. The third column is the path of travel (AF) of the centerline of the lamina 10.

The first row represents the length of the path of travel (AB) of the wrap around the first straight axis roll. The second row represents the length of the path of travel (BC) between the first straight axis roll and the compensating roll. The third row represents the length of the path of travel (CD) of the wrap around the compensating roll. The fourth row represents the length of the path of travel (DE) from the compensating roll to the pleating roll. The fifth row represents the length of the path of travel (EF) from the pleating roll to the second straight axis roll. The sixth row represents the aggregate (AF) of the lengths of the paths of travel of each column and shows no cumulative differential in the third decimal place. Note that prime symbols are omitted from the row headings for clarity.

TABLE I

| | (All values in inches) | | |
|---|---|---|---|
| PATH OF TRAVEL | EDGE OF LAMINA | MIDPOINT OF LAMINA | CENTER OF LAMINA |
| WRAP (AB) | 0.383 | 0.383 | 0.382 |
| SPAN (BC) | 14.166 | 14.180 | 14.184 |
| WRAP (CD) | 1.782 | 1.782 | 1.783 |
| SPAN (DE) | 45.057 | 44.967 | 44.942 |
| SPAN (EF) | 5.403 | 5.479 | 5.500 |
| AGGREGATE (AF) | 66.791 | 66.791 | 66.791 |

As illustrated by Table I, the aggregate paths of travel (AF) have a total differential from the edge 12 of the lamina 10 to the centerline of the lamina 10, or from either such point to the midpoint of the lamina 10 in the fourth decimal place. Such mathematical accuracy is within the limits of resolution of the hardware of the apparatus 15 typically used to produce the pleated lamina 10.

EXAMPLE II

It is desired to manufacture a pleated lamina 10 from a material about 0.20 millimeters (0.008 inches) in thickness. It is desired that such pleated lamina 10 have about 45 pleats of 1.4 millimeters (0.056 inches) in height on a spacing of about 2.5 pleats per centimeter (6.4 pleats per inch). Further, it is desired to vertically stack the ends 22 of the first straight axis roll 20 and the ends 32 of the compensating roll 30 (i.e., the horizontal offset will be 0 centimeters). Using known techniques it is apparent to one skilled in the art that such a lamina 10 has a pleated width PW of about 18.11 centimeters (7.13 inches) and an unpleated width UPW of about 25.93 centimeters (10.21 inches). Such a lamina 10 is satisfactorily produced using the apparatus 15 of FIGS. 2–6 particularly an apparatus 15 having a pleating roll 40 used in conjunction with an interdigitating roll 60.

The apparatus 15 has a pleating roll 40 with a diameter of about 5.7 centimeters (2.25 inches) measured at the outer circumference of the lands 46. The grooves 44 are about 3.175 millimeters (0.125 inches) in width, about 4.8 millimeters (0.188 inches) in depth and spaced on a pitch of about 3.96 millimeters (0.156 inches). The pleating roll 40 has a radius of curvature $R_p$ of about 215.28 centimeters (84.8 inches) providing a bow $Bow_{p''}$ at the centerline of about 15.0 millimeters (0.592 inches), a bow $Bow_{p'}$ at the outboard edges 12 of the lamina 10 of about 13.1 millimeters (0.517 inches) and a bow at the midpoints of the lamina 10 of about 14.4 centimeters (0.566 inches).

A complementary interdigitating roll 60, axially offset about one-half pitch in the cross machine direction, is provided. The circular lands 66 of the interdigitating roll 60 enter the grooves 46 of the pleating roll 40 a radial distance of about 1.4 millimeters (0.056 inches) to provide the desired pleat height.

A compensating roll 30 is provided, before and in series with the pleating and interdigitating rolls 40 and 60, to substantially equalize the aggregate paths of travel (AF) and (AF)' of the points on the centerline, midpoints and edges 12 of the lamina 10. The compensating roll 30 has a diameter of about 3.8 centimeters (1.5 inches) and a radius of curvature $R_C$ of about 10.58 meters (416.7 inches) yielding a bow $Bow_{C''}$ at the centerline of the lamina of about 3.1 millimeters (0.12 inches), a bow at the midpoint of the lamina 10 of about 2.8 millimeters (0.11 inches) and a bow $Bow_C$ at the outboard edge 12 of the lamina 10 of about 2.3 millimeters (0.089 inches). The compensating roll 30 is fixed so that the exit point of tangency D of the lamina 10 is in about the same plane as the point of tangency E of the pleating roll 40, and with a distance Span (DE)", between the ends 32 and 42 of the pleating and compensating rolls 30 and 40 of about 93.98 centimeters (37.00 inches).

Two straight axis rolls 20 and 50 are disposed outboard of and in series with the pleating and compensating rolls 30 and 40. The first straight axis roll 20 is about 2.54 centimeters (1 inch) in diameter. The second straight axis roll 50 has a diameter of about 5.71 centimeters (2.25 inches). The first straight axis roll 20 is disposed with the ends 22 directly vertical relative to the ends 32 of the compensating roll 30, and specifically about 25.4 centimeters (10 inches) apart.

The apparatus 15 of Example II provided the results illustrated in Table II which corresponds to Table I in the arrangement and presentation of the rows and columns. Again, a cumulative differential in the three aggregated paths of travel (AF) and (AF)' occurs only at the fourth decimal place, well within the resolution of typical hardware used for the apparatus 15.

TABLE II

| | (All Values in Inches) | | |
|---|---|---|---|
| PATH OF TRAVEL | EDGE OF LAMINA | MIDPOINT OF LAMINA | CENTER OF LAMINA |
| WRAP (AB) | 0.768 | 0.768 | 0.767 |
| SPAN (BC) | 9.997 | 9.997 | 9.997 |
| WRAP (CD) | 1.204 | 1.205 | 1.206 |
| SPAN (DE) | 36.604 | 36.554 | 36.528 |
| SPAN (EF) | 5.517 | 5.566 | 5.592 |
| AGGREGATE (AF) | 54.090 | 54.090 | 54.090 |

VARIATIONS

Several variations in the apparatus 15 of the present invention are feasible. For example, the disclosed sleeve of the pleating roll 40 has each land 46 throughout the axial length of the sleeve connected to all of the other lands 46 via the grooves 44, so that all the lands 46 rotate as a unitary assembly. If desired, the lands 46 may be individually rotatably mounted on the sleeve, so that each land 46 is able to rotate independently of the other lands 46.

If desired, the constant diameter nonrotating curved axis compensating roll 30 may be replaced with an axially rotatable straight axis crowned roll which is generally symmetric about its centerline. The diameter of the axially rotatably crowned roll monotonically increases as a second order function from a minimum diameter at the ends of the crowned roll to a maximum diameter at the centerline of the crowned roll. The radius of the crowned roll at the cross section registered with the centerline and at the edges 12 of the lamina 10 are found according to the methods described above for determining the bows $Bow_C$ and $Bow_C$ of the compensating roll 30 at the centerline and edges 12 of the lamina 10.

Alternatively, the compensating roll 30 may be replaced with a folding board which causes greater displacement of the centerline of the lamina 10 than the edges 12 of the lamina 10. Each of the constant diameter curved axis roll, the straight axis crowned roll and the folding board are suitable means for causing a difference in the aggregate of the paths of travel (AF) and (AF)' of transversely corresponding points on the lamina 10 as the lamina 10 travels through the apparatus 15.

In another variation, instead of the configuration of FIG. 6 having the compensating, pleating, and second straight axis rolls 30, 40 and 50 generally colinear and coplanar, the rolls 20, 30, 40 and 50 comprising the apparatus 15 may be disposed in any other arrangement, such as a substantially rectangular fashion, or in irregular dispositions, so long as the aggregate of the paths of travel (AF) and (AF)' of transversely corresponding points are substantially equalized.

A prophetic variation for the apparatus 15 is to modify the lands 46 of the pleating roll 40 from continuous toroids having a rectangular cross section, as shown, to discretely spaced rectangular toroidal segments, having circumferentially spaced radial gaps between circumferentially spaced toroidal segments. Thus, the apparatus 15 may have either continuous lands 46 or discrete lands 46 on the pleating roll 40.

Figure 7:
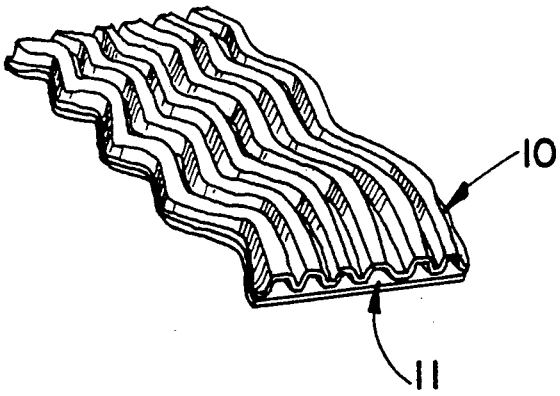
FIG. 7 is a perspective view of a laminate having a first lamina produced according to the present invention and a second lamina which is stretched in the machine direction.

Several variations in the pleated lamina 10 produced by the apparatus and method of the present invention are also feasible. For example, as illustrated in FIG. 7, the pleated lamina 10 may be joined in face to face relation with an unpleated lamina 11 to yield a unitary laminate. Face to face joining of the laminae 10 and 11 may be accomplished either adhesively or autogenously using additional rolls (not shown) and the nip defined therebetween. The unpleated lamina 11 may be elastic, yielding an elastic laminate. If the unpleated lamina 11 is elastic, it may be stretched in the machine direction, cross machine direction, or both, to yield either a uniaxially or biaxially elastic laminate, as illustrated. By joining the pleated lamina 10 to another lamina 11, a means for maintaining the pleat definition is established.

To join the lamina 10 pleated by the apparatus 15 and process of this invention to another lamina 11, either pleated or unpleated, the second straight axis roll 50 may be juxtaposed with another mutually parallel straight axis roll (not shown) to define a nip therebetween. Such roll is either grooved or smooth, depending upon whether the second lamina 11 is pleated or unpleated. The laminae 10 and 11 are confluently passed through such nip after leaving the pleating roll 40. If desired, the laminae 10 or 11 may be joined into a unitary laminate at this nip or at a nip which occurs after the nip formed in part by the second straight axis roll 50.

If autogenous joining of the laminae 10 and 11 is desired, a method such as that disclosed in U.S. Pat. No. 4,854,984 issued Aug. 8, 1989 to Ball et al., has been found suitable, which patent is incorporated herein by reference for the purpose of showing a particularly preferred method of autogenous joining of laminae. If adhesive joining is selected, a method similar to that disclosed in U.S. Pat. No. 4,377,431, issued Mar. 22, 1983 to Chodosh is suitable, which patent is also incorporated herein by reference for the purpose of disclosing a method of adhesive joining of laminae.

If desired, to accommodate the joining process, repeating rolls may be utilized. As used herein, the term "repeating roll" refers to any grooved straight axis roll, generally parallel to the second straight axis roll 50 and less than about 12.7 centimeters (5.0 inches) from the adjacent upstream straight axis roll utilized to maintain the pleat geometry. This arrangement provides the advantage that the definition of the pleats formed by the apparatus 15 described herein, or by any other apparatus, remains in the lamina 10 and are not lost as the lamina 10 is transported to the nip or other component, at which joining occurs. If the second straight axis roll 50 is one of the rolls which defines the nip to be used in the joining process, the definition of the pleats is not usually lost and repeating rolls are likely unnecessary.

Another feasible variation is to have two apparatuses 15, in parallel, each apparatus pleating a lamina 10 in the machine direction. The pleated laminae 10 have parallel and outwardly facing pleats and may be joined together to form a unitary laminate having two pleated laminae 10. The pleated laminae 10 may be joined as described above, or a third, unpleated lamina 11 may be interposed between the two pleated laminae 10.

A prophetic variation is to intermittently space the grooves 44 of the pleating roll 40. This will provide a lamina 10 having pleats of a variable pitch.

It will be further apparent to one skilled in the art, that this variation may be combined with the preceding variation to yield a unitary laminate having two outwardly facing pleated laminae 10, each with parallel but mutually different pitches or, alternatively, with one or both outwardly facing laminae 10 having a variable pitch.

It will be apparent that other variations are feasible without departure from the spirit and scope of the invention.

What is claimed is:

1. An apparatus for pleating a lamina having two edges and a centerline, said apparatus comprising in series:

a means for supplying a lamina;

a first straight axis roll;

a first curved axis roll having ends, a generally stationary axis of curvature, and a first radius of curvature;

a second curved axis roll having ends, a generally stationary axis of curvature, an axially rotatable sleeve having a plurality of circumferentially oriented grooves therein, and a second radius of curvature, said second radius of curvature being selected based on the final pleated width of the lamina;

a second straight axis roll; and the ends of said first curved axis roll being arranged relative to the ends of said second curved axis roll to form a distance span, said distance span and said first radius of curvature being adjusted relative to said second radius of curvature such that the aggregate of the paths of travel of an edge of the lamina from said first straight axis roll to said second straight axis roll is substantially equal the aggregate of the paths of travel of the centerline of the lamina from said first straight axis roll to said second axis roll.

2. An apparatus according to claim 1 wherein the lamina wraps said second curved axis roll through a subtended angle of less than 180°.

3. An apparatus according to claim 2 wherein said lamina intercepts said second curved axis roll substantially only at a point of tangency.

4. An apparatus according to claim 1 wherein one of said paths of travel is a shorter path of travel, and wherein the difference wherein said aggregates of said paths of travel are mathematically less than about 0.5% of the shorter path of travel.

5. An apparatus according to claim 1 wherein the planes defined by said stationary axes of said first and second curved axis rolls are generally parallel.

6. An apparatus according to claim 1 further comprising a third straight axis roll juxtaposed with said second straight axis roll to define a nip therebetween, said pleated lamina being passed in face to face relation with a second lamina through said nip.

7. An apparatus according to claim 6 further comprising a means for joining said pleated lamina to said second lamina.

* * * * *

UNITED STATES PATENT AND TRADEMARK OFFICE
CERTIFICATE OF CORRECTION

PATENT NO. : 5,185,052

DATED : February 9, 1993

INVENTOR(S) : Charles W. Chappell et al.

It is certified that error appears in the above-identified patent and that said Letters Patent is hereby corrected as shown below:

| | |
|---|---|
| Column 8, line 5 | delete "an" and insert --and--. |
| Column 9, line 55 | after "roll" insert --30--. |
| Column 10, line 41 | delete "*C'* " and insert --*C"*--, in both occurences. |
| Column 13, line 64 | after "the' (1st. occ.) insert --wrap--. |
| Column 13, line 65 | after "entrance" insert --and exit--. |
| Column 14, line 1 | delete "p e" and insert --profile--. |
| Column 14, line 3 | delete "prefer" and insert --preferably below--. |
| Column 14, line 17 | delete "sub" and insert --subtended angle--. |
| Column 14, line 25 | after "(BC)' " insert --from--. |
| Column 14, line 26 | after "roll" insert --20--. |
| Column 14, line 27 | after "roll" insert --30 is--. |
| Column 14, line 28 | delete "s" and insert --straight--. |
| Column 14, line 34 | after "which" insert --line--. |
| Column 14, lines 39 & 42 | after "axis" insert --roll--. |
| Column 14, line 49 | after "axis" insert --roll 20--. |
| Column 14, lines 50 & 67 | delete "$(Dia_C - Dia_{FS})$" and insert --$(Dia_{C'} - Dia_{FS''})$--. |
| Column 14, line 61 | after "Pythagorean" insert --theorem-- |
| Column 14, line 63 | after "this" insert--can--. |
| Column 14, lines 67 & 68 | after "*C*" insert -- '--. |
| Column 14, line 68 | delete "*178*" and insert --½--. |
| Column 15, line 1 | after "the" (1st. occ.) insert --wrap-- |
| Column 15, line 7 | after "is" insert --designated--. |
| Column 15, line 11 | after "*C*" insert --''-- in both occurences. |

UNITED STATES PATENT AND TRADEMARK OFFICE

CERTIFICATE OF CORRECTION

PATENT NO. : 5,185,052

DATED : February 9, 1993

INVENTOR(S) : Charles W. Chappell et al.

It is certified that error appears in the above-identified patent and that said Letters Patent is hereby corrected as shown below:

| | |
|---|---|
| Column 15, line 17 | delete "firs" and insert --first straight--. |
| Column 15, line 30 | after "the" (1st. occ.) insert--sum--. |
| Column 15, line 37 | after "be" insert --express--. |
| Column 15, lines 40 & 41 | after "C" insert --C'--. |
| Column 15, line 42 | delete "Y" and insert --γ--. |
| Column 15, line 45 | after "and" and insert --the--. |
| Column 15, line 53 | after "the" (1st. occ.) insert--second--. |
| Column 15, line 55 | after "this" insert --triangle--. |
| Column 15, line 62 | after "and" insert --the--. |
| Column 15, line 63 | delete "a" and insert --aggregate--. |
| Column 16, line 5 | delete "-". |
| Column 16, line 53 | after "inches" insert --), so--. |
| Column 16, line 53 | delete "pleat" and insert --pleats--. |
| Column 16, line 58 | after "intermediate" insert --wraps--. |
| Column 16, line 59 | after "be" insert --expressed--. |
| Column 16, line 62 | after "(CD)" insert --'--. |
| Column 16, line 64 | after "described" insert --path--. |
| Column 16, line 66 | after "through" insert --the--. |
| Column 16, line 67 | after "not" insert --have--. |
| Column 17, line 22 | delete "90" and insert --90°-- |
| Column 17, lines 22 & 24 | delete "C" and insert --C'--. |
| Column 18, line 5 | after "lamina" insert --10--. |
| Column 20, line 21 | after "0.25" delete --)--. |
| Column 20, line 45 | delete "an" and insert --and--. |

UNITED STATES PATENT AND TRADEMARK OFFICE

CERTIFICATE OF CORRECTION

PATENT NO. : 5,185,052

DATED : February 9, 1993

INVENTOR(S) : Charles W. Chappell et al.

It is certified that error appears in the above-indentified patent and that said Letters Patent is hereby corrected as shown below:

Column 20, line 60 delete "toward" and insert --towards--.

Signed and Sealed this

Seventh Day of October, 1997

*Attest:*

*Attesting Officer*

Bruce Lehman

BRUCE LEHMAN

*Commissioner of Patents and Trademarks*